US007377123B2

(12) United States Patent
Byrne et al.

(10) Patent No.: US 7,377,123 B2
(45) Date of Patent: May 27, 2008

(54) REFRIGERATOR WITH THROUGH-THE-DOOR BEVERAGE CAN DISPENSER

(75) Inventors: Robert M. Byrne, Lima, OH (US); Bret Kline, Columbus, OH (US)

(73) Assignee: American Trim, L.L.C., Lima, OH (US)

( * ) Notice: Subject to any disclaimer, the term of this patent is extended or adjusted under 35 U.S.C. 154(b) by 156 days.

(21) Appl. No.: 11/428,632

(22) Filed: Jul. 5, 2006

(65) Prior Publication Data

US 2006/0254302 A1 Nov. 16, 2006

Related U.S. Application Data

(63) Continuation-in-part of application No. 10/754,440, filed on Jan. 9, 2004, now abandoned.

(51) Int. Cl.
*F25D 25/00* (2006.01)

(52) U.S. Cl. ..... 62/378; 221/256

(58) Field of Classification Search ..... 62/378; 221/183, 256, 266

See application file for complete search history.

(56) References Cited

U.S. PATENT DOCUMENTS

| | | | | |
|---|---|---|---|---|
| 1,626,429 | A | | 4/1927 | Ruoff |
| 2,274,065 | A | | 2/1942 | Hull et al. |
| 2,779,169 | A | | 1/1957 | Sharpe et al. |
| 2,852,327 | A | | 9/1958 | Mason |
| 3,795,345 | A | | 3/1974 | Baxendale |
| 4,663,943 | A | | 5/1987 | Dyment et al. |
| 4,676,074 | A | * | 6/1987 | Morgan et al. ..... 62/277 |
| 4,823,984 | A | | 4/1989 | Ficken |
| 4,899,904 | A | * | 2/1990 | Dooley et al. ..... 220/592.16 |
| 5,009,329 | A | * | 4/1991 | Farrentine ..... 221/175 |
| 5,247,798 | A | | 9/1993 | Collard, Jr. |
| 5,651,476 | A | | 7/1997 | Percy et al. |
| 5,788,177 | A | * | 8/1998 | Keller et al. ..... 242/379.1 |
| 5,899,358 | A | * | 5/1999 | Daumueller ..... 221/196 |
| 6,173,582 | B1 | | 1/2001 | Hixson |
| 6,234,345 | B1 | | 5/2001 | Minh et al. |
| 6,390,328 | B1 | | 5/2002 | Obermeier et al. |
| 6,481,014 | B1 | | 11/2002 | Banks et al. |
| 2003/0218023 | A1 | | 11/2003 | Zangari et al. |

FOREIGN PATENT DOCUMENTS

| | | |
|---|---|---|
| DE | 1294627 | 5/1969 |
| EP | 0490693 A2 | 6/1992 |
| JP | 5-135257 | 6/1993 |

* cited by examiner

*Primary Examiner*—Melvin Jones
(74) *Attorney, Agent, or Firm*—Rankin, Hill & Clark LLP

(57) ABSTRACT

A refrigerator with a through-the-door beverage can dispenser that includes a chute disposed within a refrigerated interior space that is adapted to receive and hold a plurality of beverage cans in a side-by-side relationship for sequential discharge from a bottom end of the chute. The beverage dispenser includes a rotatable drum that in a loading position has a trough portion adapted to receive a beverage can discharged from the bottom end of the chute and a barrel portion adapted to sealingly fill a passage through a door of the refrigerator. The drum is rotatable by hand from the loading position to a dispensing position where the trough portion of the drum is adjacent to the passage through the door to permit removal of a beverage can from the trough without opening the door.

20 Claims, 5 Drawing Sheets

REFRIGERATOR WITH THROUGH-THE-DOOR BEVERAGE CAN DISPENSER

CROSS-REFERENCE TO RELATED APPLICATION

This application is a continuation-in-part of U.S. application Ser. No. 10/754,440, filed Jan. 9, 2004 now abandoned.

BACKGROUND OF THE INVENTION

1. Field of Invention

The present invention relates to a refrigerator having a through-the-door beverage can dispenser.

2. Description of Related Art

Many devices are known for individually dispensing refrigerated beverage cans. Vending machines, for example, accept coins or other forms of payment and then electro-mechanically discharge a refrigerated beverage can into a basket for retrieval by a consumer. Other known beverage can dispensers simply consist of refrigerated cabinets having doors that swing open or slide open to allow a consumer to retrieve a beverage can from a shelf or a gravity-fed dispensing rack situated within the cabinet.

Electro-mechanically operated devices are expensive, and can be somewhat complicated to load with beverage cans. Refrigerated cabinets with swinging or sliding doors are generally less expensive than electro-mechanically operated beverage can dispensing devices and are easier to load, but they tend to be substantially less energy efficient because they allow refrigerated air to escape each time the door is opened by a consumer to retrieve a beverage can from the cabinet. A non-electromechanical beverage can dispenser that provides the simplicity of a refrigerated cabinet, but does not allow large amounts of refrigerated air to escape each time a beverage can is dispensed, is needed.

BRIEF SUMMARY OF THE INVENTION

The present invention provides a refrigerator with a through-the-door beverage can dispenser. In one embodiment of the invention, the refrigerator comprises a cabinet that defines a refrigerated interior space. Two or more shelves are disposed within the cabinet. The shelves support food items in the refrigerated interior space. At least one door is hingedly connected to the cabinet. The door is movable between an open position in which an opening in the cabinet is not covered by the door and food items can be inserted into and/or removed from in the refrigerated interior space through the opening, and a closed position in which the door covers the opening in the cabinet and substantially seals the refrigerated interior space from ambient air surrounding an outer side of the refrigerator. A beverage can dispenser comprising a chute is operatively associated with an inner side of the door such that the chute is disposed within the refrigerated interior space when the door is in the closed position. The chute has a top end for sequentially receiving a plurality of beverage cans, a central section for holding the plurality of beverage cans in a side-by-side relationship, and a bottom end for sequentially discharging the plurality of beverage cans from the chute. A drum is rotatably mounted on the door. The drum is rotatable by hand only and not through the use of any electro-mechanical devices between a loading position in which a barrel portion of the drum sealingly fills a passage through the door and a trough portion of the drum receives a bottommost beverage can discharged from the bottom end of the chute, and a dispensing position in which the bottommost beverage can be withdrawn from the trough through the passage in the door. To dispense a beverage can through the door of the refrigerator, a user rotates the drum until the trough containing a beverage can discharged from the bottom end of the chute is positioned adjacent to the passage through the refrigerator door. The user removes the beverage can from the trough and then releases the drum, which is preferably spring-biased to rotate back to the loading position where the barrel portion sealingly fills the passage.

In another preferred embodiment of the invention, the chute is operatively associated with one of the shelves within the refrigerated interior space. In yet another preferred embodiment of the invention, the drum is rotatably mounted to the chute or to the shelf, rather than the refrigerator door.

In every embodiment of the invention, the beverage dispenser reduces the amount of space taken up within a refrigerator to store beverage cans. Moreover, the beverage can dispenser facilitates the sequential removal of one beverage can at a time without requiring the door of the refrigerator to be opened. This reduces the number of times the refrigerator door must be opened per day, which saves energy.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
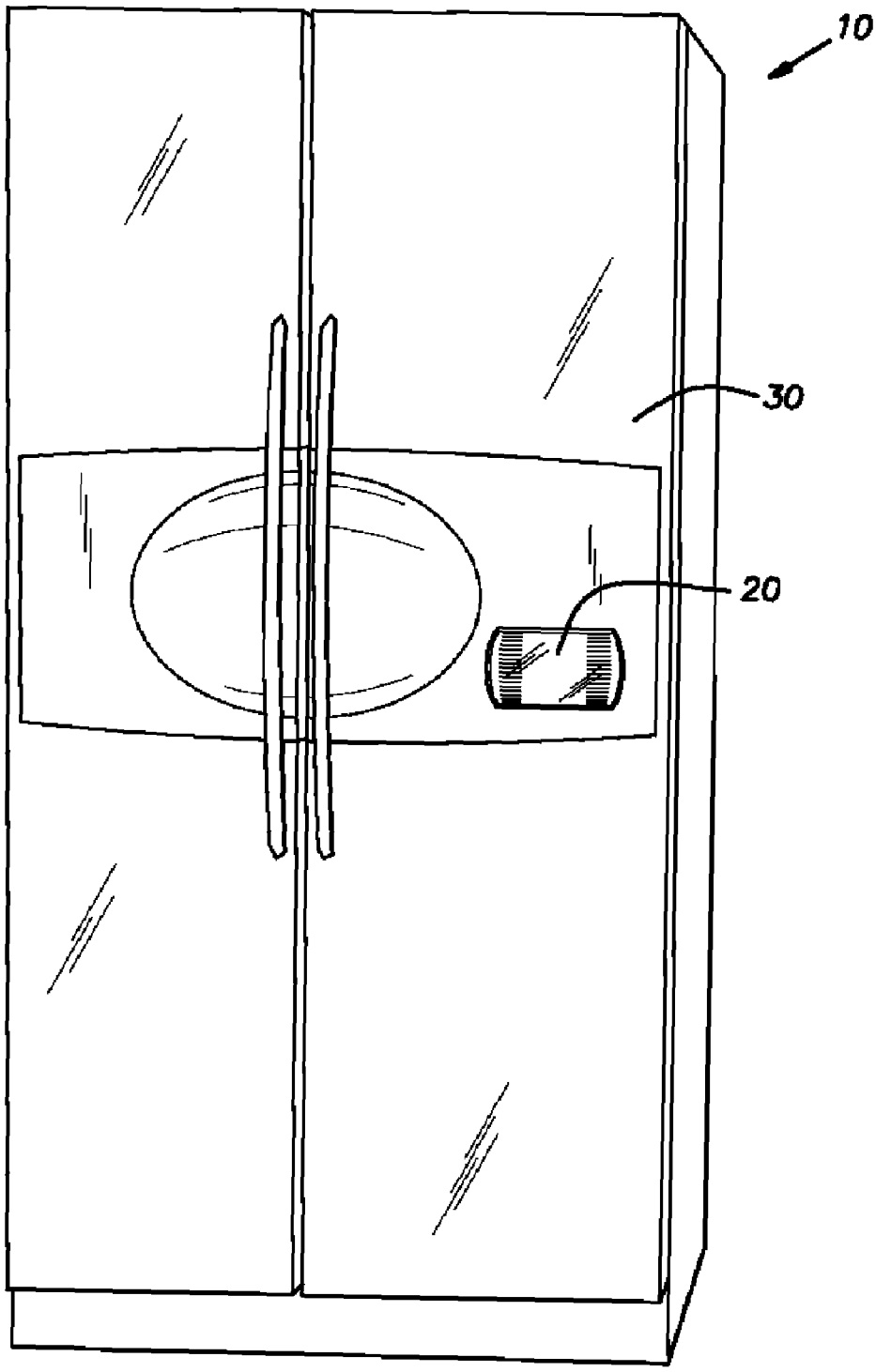
FIG. 1 is front perspective view of a refrigerator provided with a beverage can dispenser according to the present invention.

FIG. 1 shows a front perspective view of a side-by-side style refrigerator 10 provided with a beverage can dispenser 20 according to the present invention. It will be appreciated that the style of refrigerator is not critical to the invention and that it is only necessary that the refrigerator have a door that can be opened and closed to allow a user to access food items stored on shelves therein. Accordingly, in addition to a traditional side-by-side refrigerator, a refrigerator according to the invention could also be a single door refrigerator, a top-freezer refrigerator, a bottom-freezer refrigerator or any other configuration of refrigerator that is provided with a door.

Figure 2:
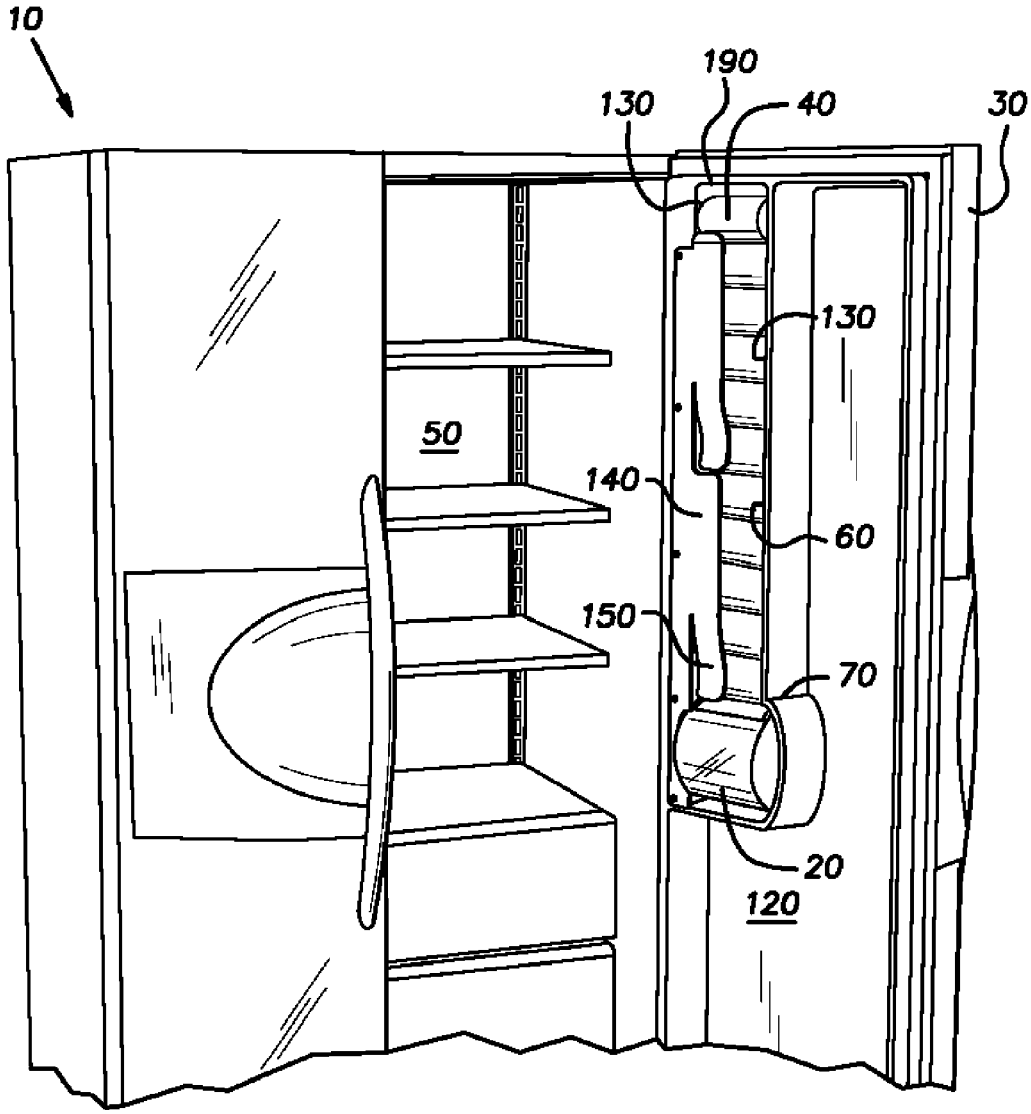
FIG. 2 is a perspective view of a portion of the refrigerator shown in FIG. 1 with the refrigerator door in an open position.

FIG. 2 shows a perspective view of a portion of the refrigerator 10 shown in FIG. 1, with the refrigerator door 30 in an open position. The beverage can dispenser 20 allows a user to retrieve a refrigerated beverage can 40 from a refrigerated interior space 50 of the refrigerator 10 without opening the door 30 and thereby exposing the food and beverages stored on the shelves therein to the relatively warm ambient air outside the refrigerator 10.

With reference to FIG. 2, the beverage can dispenser 20 comprises a chute 60 that is operatively associated with the refrigerated interior space 50 of the refrigerator 10. The chute 60 is adapted to receive and hold a plurality of beverage cans 40 in a side-by-side relationship for sequential discharge from a bottom end 70 of the chute 60. The chute 60 can be a separate component that is attached to the interior surface 120 of the refrigerator door 30 using fasteners or adhesives. More preferably, however, the chute 60 is integrally formed as part of the interior surface 120 of the refrigerator door 30.

Figure 3:
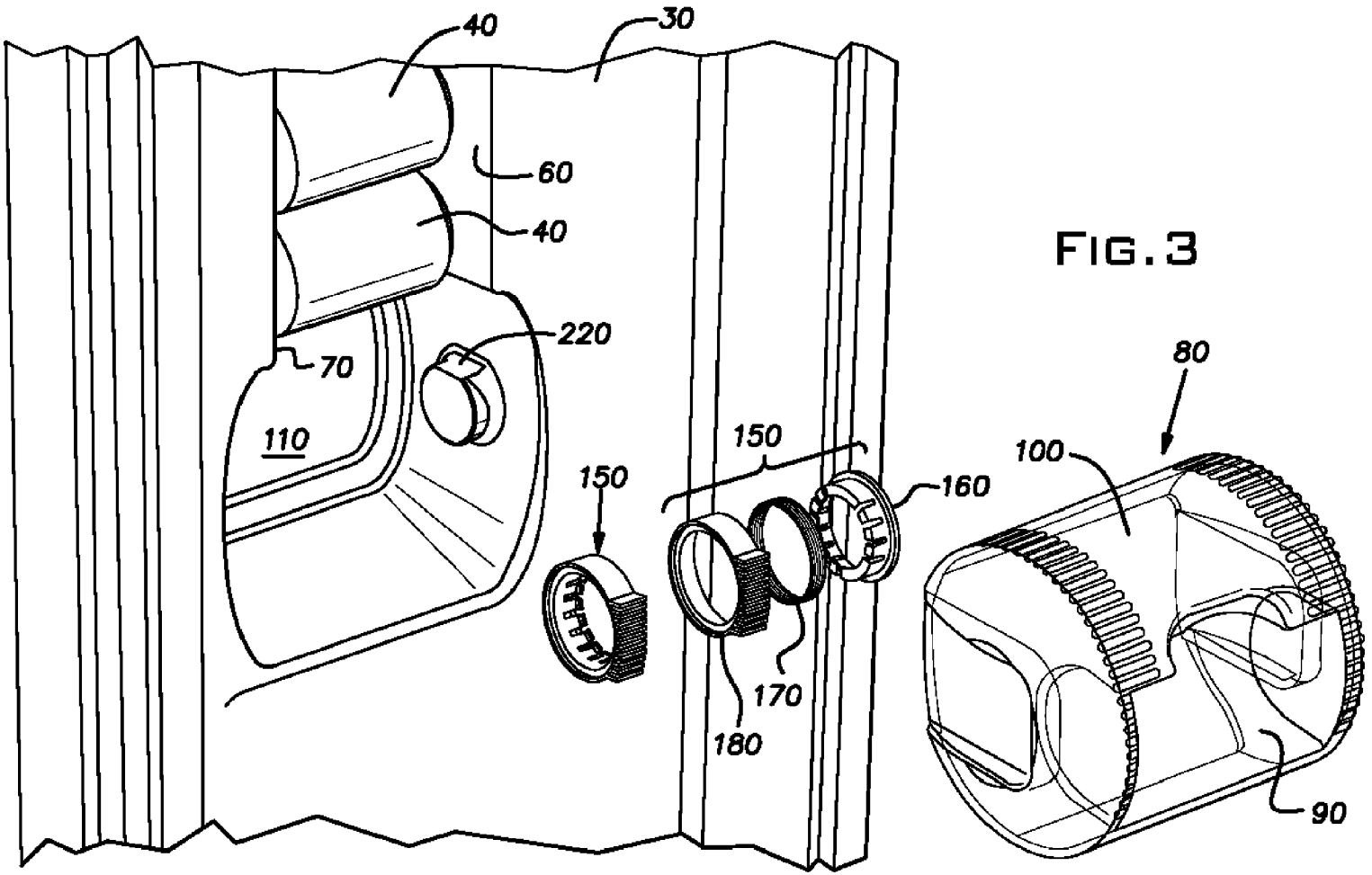
FIG. 3 is an exploded detail perspective view of the beverage can dispenser shown in FIG. 2.

In the embodiment of the invention illustrated in FIGS. 2 and 3, the chute 60 holds a plurality of beverage cans 40 in a substantially vertical side-by-side orientation for sequential discharge from the bottom end 70 of the chute 60. Beverage cans 40 can be sequentially loaded into the chute 60 from a top end 190. The chute 60 can comprise a pair of spaced-apart walls 130 that project from the interior surface 120 of the door and one or more plates 140 that extend from at least one of the panels 130, such as shown in FIG. 2. The chute 60 preferably has generally rectangular shape in cross-section that is sized to accommodate standard size twelve-ounce (355 ml) beverage cans 40. The plates 140 preferably include one or more fingers 150 that extend into the chute 60 to frictionally retard the rate at which beverage cans fall by the force of gravity from the top end 190 of the chute 60 to the bottom end 70 of the chute 60.

Figure 4:
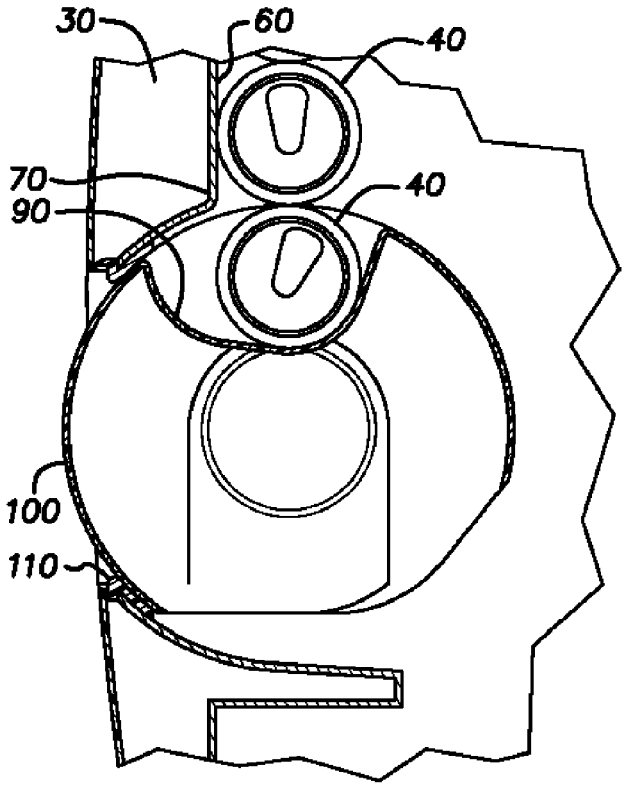
FIG. 4 is a schematic side view of a rotatable drum portion of a beverage can dispenser according to the invention in a first position.
Figure 5:
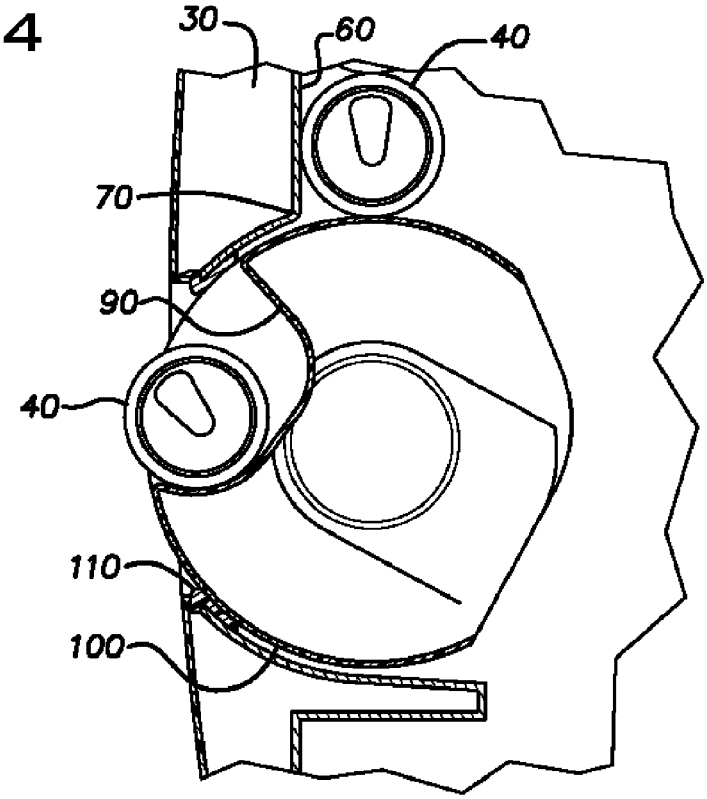
FIG. 5 is a schematic side view of the rotatable drum portion of the beverage can dispenser shown in FIG. 5 after it has been rotated to a second position.

With reference to FIG. 3, the beverage can dispenser 20 comprises a drum 80 having a trough portion 90 and a barrel portion 100. The trough portion 90 is adapted to receive a beverage can 40 discharged from the bottom end 70 of the chute 60 when the drum is in a loading position. The barrel portion 100 is adapted to sealingly fill a passage 110 provided through the refrigerator door 30 when the drum is in the loading position, as schematically shown in FIG. 4. The drum 80 must be rotatable from the loading position to a dispensing position, such as is schematically shown in FIG. 5, where the trough portion 90 of the drum 80 is positioned adjacent to the passage 110 through the door 30 in order to permit removal of a beverage can 40 from the trough portion 90. One or more gaskets can be provided around the periphery of the passage 110 to insure that a good seal is formed between the barrel portion 100 of the drum 80 and the passage 110, which prevents the escape of cold air from an interior portion 50 of the refrigerator 10. A plurality of knurls 230 can optionally be provided on the outer surface of the drum 80 to provide a structure a user may grip in order to rotate the drum 80.

The drum 80 is preferably a hollow structure that is formed of plastic (e.g., by injection molding). The drum 80 is preferably sealed after substantially all of the air has been removed from the hollow interior under vacuum. Alternatively, the hollow interior of the drum 80 can be filled with argon or other inert gas, or the interior portion of the drum 80 can be filled with expanded polystyrene foam insulation. In each case, at least the interior portion of drum 80 provides an insulation barrier that prevents the cold, refrigerated air from within the refrigerator from be transmitted through the drum, which could cause condensation to build up on the portion of the drum 80 that is exposed to warm, humid, ambient air through the passage 110 in the door 30. In addition, insulating the drum in such a manner inhibits the transfer of heat from the outside of the refrigerator into the interior of the refrigerator through the drum.

FIG. 3 shows an exploded view of the beverage dispenser 20 taken from a perspective facing the interior surface 120 of the refrigerator door 30. In the embodiment illustrated in FIG. 3, the drum 80 is mounted on a pair of bearing assemblies 150, each of which is supported by a pin 220 that projects from the door 30. In the preferred embodiment of the invention, the bearing assemblies 150 include an annular fixed hub 160, a torsion spring 170 disposed on the annular fixed hub 160, and a rotating annular ring 180 that fits over the torsion spring 170 and mates with the annular fixed hub 160. The torsion spring 170 is preferably biased to return the drum to the loading position where the barrel portion 100 is positioned adjacent to the passage 110 in the door 30 and the trough portion 90 is positioned to receive a beverage can 40 discharged from the bottom end of the chute 60. One or more stops (not shown) can be formed on the drum 80 and/or on the door 30 to limit the range of rotation of the drum 80.

One of the primary advantages realized by the refrigerator according to the invention is that it does not require the use of any electro-mechanical devices in order to operate the beverage dispenser. A user sequentially loads beverage cans into the top end of the chute. The beverage cans are held in the chute in a side-by-side relationship in the refrigerated interior space of the refrigerator. Once all of the beverage cans have been placed into the chute, the user closes the door and the beverage cans become chilled. The beverage dispenser is thus charged and ready for use. To dispense a beverage can from the refrigerator, the user rotates, if necessary, the drum by hand until a beverage can is discharged from the bottom end of the chute into the trough portion of the drum. Once a beverage can is received within the trough portion of the drum, the user rotates the drum by hand until the trough portion of the drum is positioned adjacent to the passage through the door. At that point, the user can retrieve the beverage can from the trough portion and then release or let go of the drum. Preferably, the drum is spring-biased on bearing assemblies to return the drum back to the loading position where the barrel portion contacts and seals off the passage through the door. No electro-mechanical devices of any type are used to rotate the drum and/or to dispense a beverage can from the refrigerated interior space of the refrigerator to the user.

Figure 6:
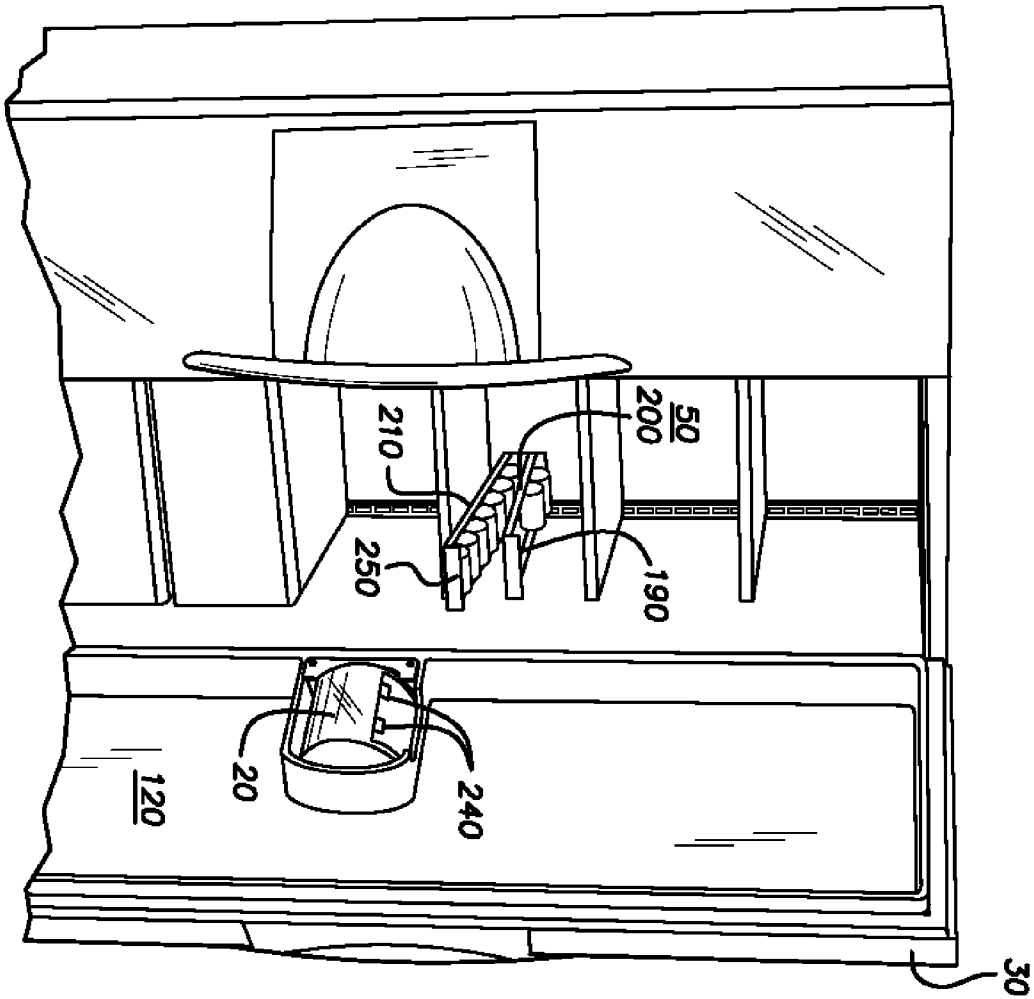
FIG. 6 is a perspective view of another embodiment of a beverage can dispenser according to the invention.

It will be appreciated that the chute 60 does not have to be formed on the door 30 of the refrigerator 10. In an alternative embodiment of the invention illustrated in FIG. 6, the chute 60 is formed as a shelf-type structure within the refrigerated interior space 50 of the refrigerator 10. The chute 60 holds a plurality of beverage cans 40 in a serpentine side-by-side stack. Beverage cans 40 loaded into the top end 190 of the chute roll down a first relatively low angle incline 200 toward a rear part of the refrigerator 10 then drop into and roll down a second relatively low angle incline 210 toward the bottom end 70 of the chute 60. Tabs 240 can be provided on the rotatable drum 80 for depressing a hinged stop bar 250 that keeps the beverage cans 40 from falling out of the chute 60 when the refrigerator door 30 is open.

A serpentine shelf-mounted chute is preferred over a vertical door-mounted chute for several reasons. First the beverage cans do not have to be raised as high to be loaded into the top end of the chute. Second, beverage cans placed into the top end of the serpentine shelf-mounted chute slowly roll, as opposed to fall, toward the bottom end of the chute. Third, a user can easily see how many beverage cans are remaining in the serpentine shelf-mounted mounted chute. Fourth, the serpentine shelf-mounted chute does not take up space on the refrigerator door. And fifth, a serpentine shelf-mounted chute can be sized to accommodate twelve or more beverage cans at a time and can allow for the removal of beverage cans from the refrigerator when the refrigerator door is open.

It will also be appreciated that the drum need not be connected to the door of the refrigerator. The drum can alternatively be mounted to a separate support structure within the refrigerated interior space of the refrigerator. It is only critical that the bottom end of the chute be properly aligned with respect to the trough portion of the drum, and that the barrel portion of the drum be positioned to seal off the passageway through the door, when the door of the refrigerator is closed.

The beverage can dispenser of a refrigerator according to the invention reduces the amount of space taken up within a refrigerator to store beverage cans. Moreover, the beverage can dispenser according to the invention facilitates the sequential removal of one beverage can at a time from the refrigerator without requiring the door of the refrigerator to be opened. This reduces the number of times the refrigerator door must be opened per day, which saves energy.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A refrigerator comprising:

a cabinet defining a refrigerated interior space;

a plurality of shelves disposed within the cabinet for for supporting food items in the refrigerated interior space;

at least one door hingedly connected to the cabinet, the door being movable between an open position in which an opening in the cabinet is not covered by the door and food items can be inserted into and/or removed from in the refrigerated interior space through the opening, and a closed position in which the door covers the opening in the cabinet and substantially seals the refrigerated interior space from ambient air surrounding an outer side of the refrigerator; and a beverage can dispenser comprising:

a chute operatively associated with an inner side of the door such that the chute is disposed within the refrigerated interior space when the door is in the closed position, the chute having a top end for sequentially receiving a plurality of beverage cans, a central section for holding the plurality of beverage cans in a side-by-side relationship, and a bottom end for sequentially discharging the plurality of beverage cans from the chute, and a drum rotatably mounted on the door, the drum being rotatable by hand only and not through the use of any electro-mechanical devices between a loading position in which a barrel portion of the drum sealingly fills a passage through the door and a trough portion of the drum receives a bottommost beverage can discharged from the bottom end of the chute, and a dispensing position in which the bottommost beverage can be withdrawn from the trough through the passage in the door.

2. The refrigerator according to claim 1 wherein the chute holds the plurality of beverage cans in a serpentine side-by-side stack.

3. The refrigerator according to claim 1 wherein the chute holds the plurality of beverage cans in a substantially vertical side-by-side stack.

4. The refrigerator according to claim 1 further comprising one or more fingers extending into the chute for retarding the rate at which the plurality of beverage cans fall when they are sequentially received in the top end of the chute.

5. The refrigerator according to claim 1 wherein the drum rotates on a pair of bearings that are spring-biased to rotate the drum to loading position from the dispensing position.

6. The refrigerator according to claim 1 wherein the drum comprises a plastic structure having a hollow interior.

7. The refrigerator according to claim 6 wherein the hollow interior is vacuum-sealed.

8. The refrigerator according to claim 6 wherein the hollow interior is filled with an inert gas.

9. The refrigerator according to claim 8 wherein the inert gas is argon.

10. The refrigerator according to claim 6 wherein the hollow interior is filled with expanded polystyrene foam insulation.

11. A refrigerator comprising:

a cabinet defining a refrigerated interior space;

at least one door hingedly connected to the cabinet, the door being movable between an open position in which an opening in the cabinet is not covered by the door and food items can be inserted into and/or removed from in the refrigerated interior space through the opening, and a closed position in which the door covers the opening in the cabinet and substantially seals the refrigerated interior space from ambient air surrounding an outer side of the refrigerator; and a beverage can dispenser comprising:

a chute operatively associated with a shelf within the refrigerated interior space, the chute having a top end for sequentially receiving a plurality of beverage cans, a central section for holding the plurality of beverage cans in a side-by-side relationship, and a bottom end for sequentially discharging the plurality of beverage cans from the chute, and a drum rotatably mounted on the door, the drum being rotatable by hand only and not through the use of any electro-mechanical devices between a loading position in which a barrel portion of the drum sealingly fills a passage through the door and a trough portion of the drum receives a bottommost beverage can discharged from the bottom end of the chute, and a dispensing position in which the bottommost beverage can be withdrawn from the trough through the passage in the door.

12. The refrigerator according to claim 11 wherein the chute holds the plurality of beverage cans in a serpentine side-by-side stack.

13. The refrigerator according to claim 11 wherein the drum rotates on a pair of bearings that are spring-biased to rotate the drum to loading position from the dispensing position.

14. The refrigerator according to claim 11 wherein the drum comprises a plastic structure having a hollow interior.

15. The refrigerator according to claim 14 wherein the hollow interior is vacuum-sealed.

16. The refrigerator according to claim 14 wherein the hollow interior is filled with an inert gas.

17. The refrigerator according to claim 16 wherein the inert gas is argon.

18. The refrigerator according to claim 14 wherein the hollow interior is filled with expanded polystyrene foam insulation.

19. A refrigerator comprising:

a cabinet defining a refrigerated interior space;

at least one door hingedly connected to the cabinet, the door being movable between an open position in which an opening in the cabinet is not covered by the door and food items can be inserted into and/or removed from in the refrigerated interior space through the opening, and a closed position in which the door covers the opening in the cabinet and substantially seals the refrigerated interior space from ambient air surrounding an outer side of the refrigerator; and a beverage can dispenser comprising:

a chute operatively associated with a shelf connected to the cabinet within the refrigerated interior space, the chute having a top end for sequentially receiving a plurality of beverage cans, a central section for holding the plurality of beverage cans in a side-by-side relationship, and a bottom end for sequentially discharging the plurality of beverage cans from the chute, and a drum rotatably mounted to the chute or to the shelf, the drum being rotatable by hand only and not through the use of any electro-mechanical devices between a loading position in which a barrel portion of the drum sealingly fills a passage through the door and a trough portion of the drum receives a bottom-most beverage can discharged from the bottom end of the chute, and a dispensing position in which the bottommost beverage can be withdrawn from the trough through the passage in the door.

20. The refrigerator according to claim 19 wherein the chute holds the plurality of beverage cans in a serpentine side-by-side stack, the drum rotates on a pair of bearings that are spring-biased to rotate the drum to loading position from the dispensing position, and the drum comprises a plastic structure having a hollow interior.

* * * * *